United States Patent [19]

Morell et al.

[11] Patent Number: 4,551,933

[45] Date of Patent: Nov. 12, 1985

[54] SKI BOOT

[75] Inventors: Joseph Morell, Annecy; Jean Paris, Sevrier; Roland Petrini, Chambery, all of France

[73] Assignee: Salomon S.A., Annecy, France

[21] Appl. No.: 578,428

[22] Filed: Feb. 9, 1984

[30] Foreign Application Priority Data

Feb. 9, 1983 [FR] France ..... 83 02437

[51] Int. Cl.[4] ..... A43B 5/04

[52] U.S. Cl. ..... 36/120; 36/50

[58] Field of Search ..... 36/117, 118, 119, 120, 36/121, 50

[56] References Cited

U.S. PATENT DOCUMENTS 4,160,332 7/1979 Salomon ..... 36/119
4,222,184 9/1980 Kastinger ..... 36/121

FOREIGN PATENT DOCUMENTS 0053340 6/1982 European Pat. Off. ..... 36/120
2730550 1/1979 Fed. Rep. of Germany ..... 36/121
57-86301 5/1982 Japan .

*Primary Examiner*—Louis K. Rimrodt
*Attorney, Agent, or Firm*—Sandler & Greenblum

[57] ABSTRACT

A rear-entry type ski boot having an upper including a front cuff and a rear spoiler. The upper is at least partially journalled on a rigid shell base for latching the cuff and spoiler around the leg of the skier. Also provided is means for automatically closing the spoiler in response to forward flexion of the cuff. This closing means includes an elastic system for biasing the spoiler toward the cuff, a retention means for selectively blocking the spoiler from closing on the cuff under the influence of the elastic system, and relay means for relaying the forward flexion of the cuff to the retention means. When the foot of the skier flexes forward, the relay means moves the retention means out of its blocking position so that the spoiler can freely move forward to close on the cuff under the influence of the elastic system.

56 Claims, 18 Drawing Figures

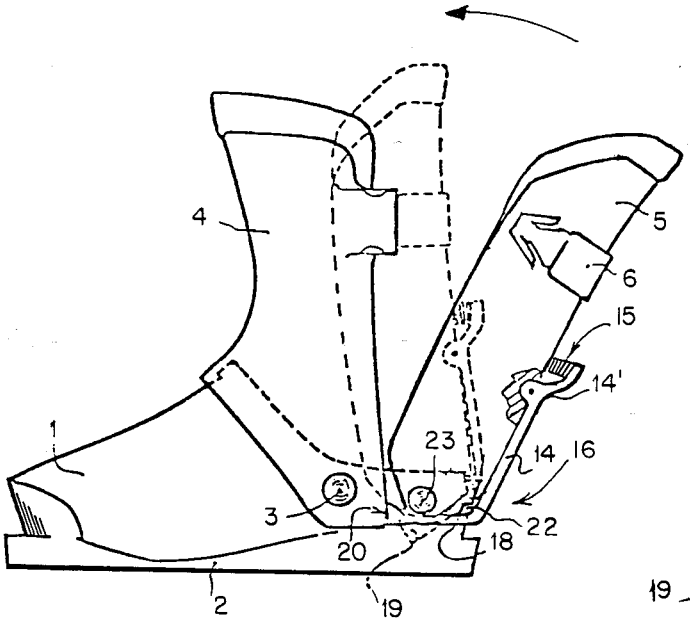
FIG. 3.
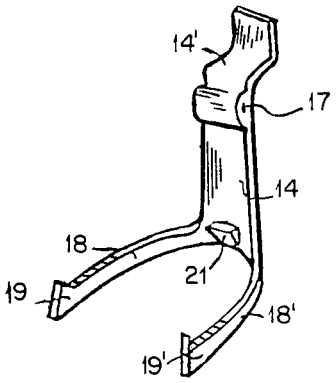
FIG. 4.
FIG. 5.
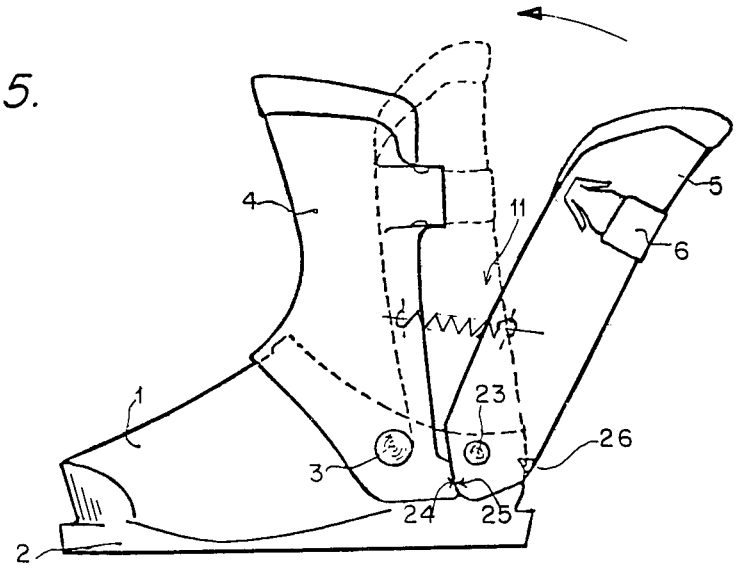

FIG. 8.
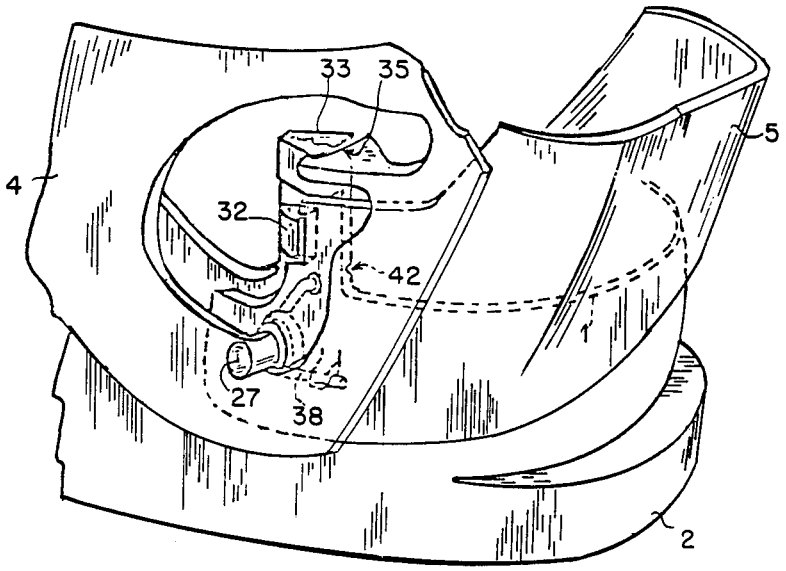
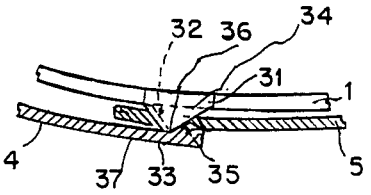
FIG. 9a.
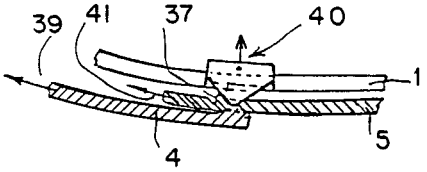
FIG. 9b.

FIG. 10.
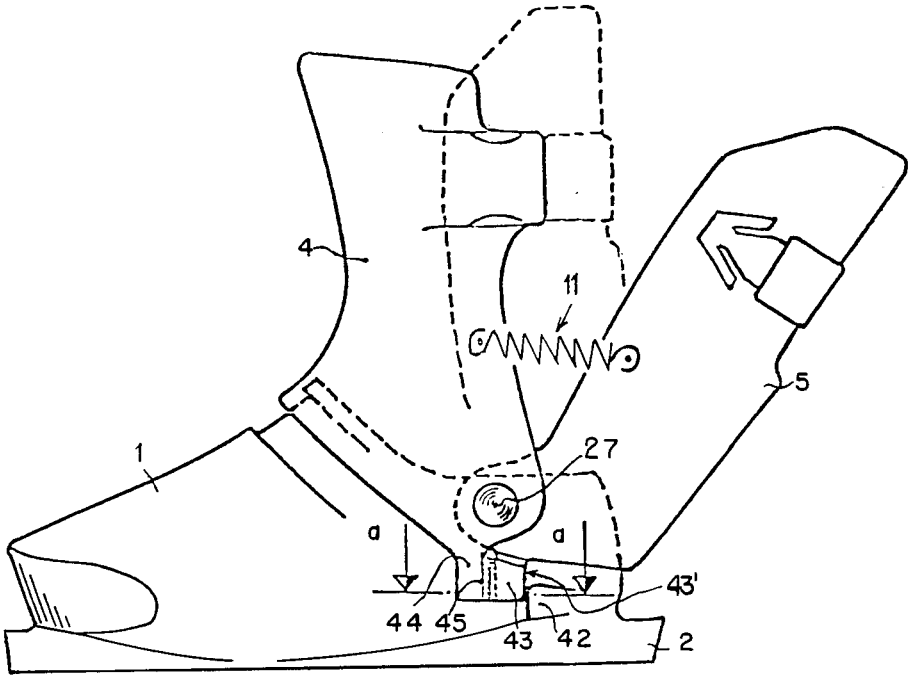
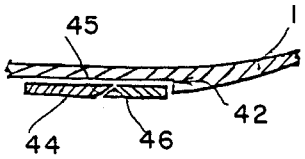
FIG. 10a.
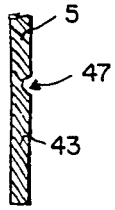
FIG. 10b.

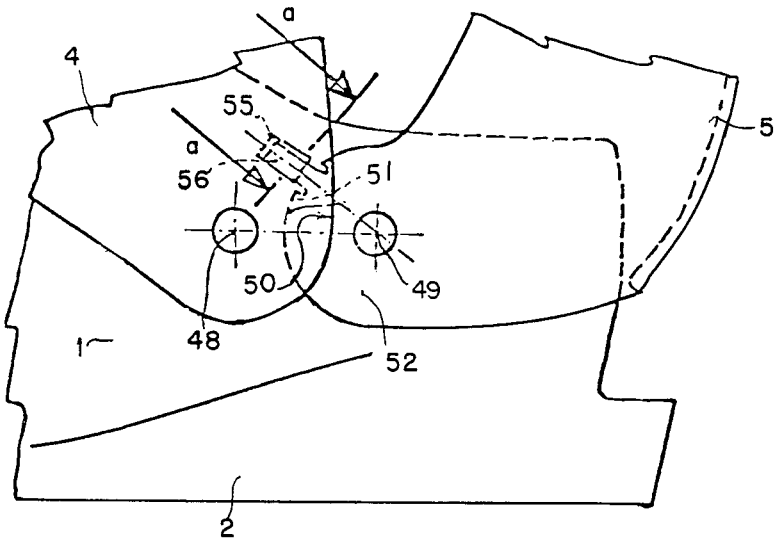
FIG. 11.
FIG. 11a.
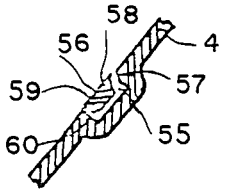

FIG. 12.
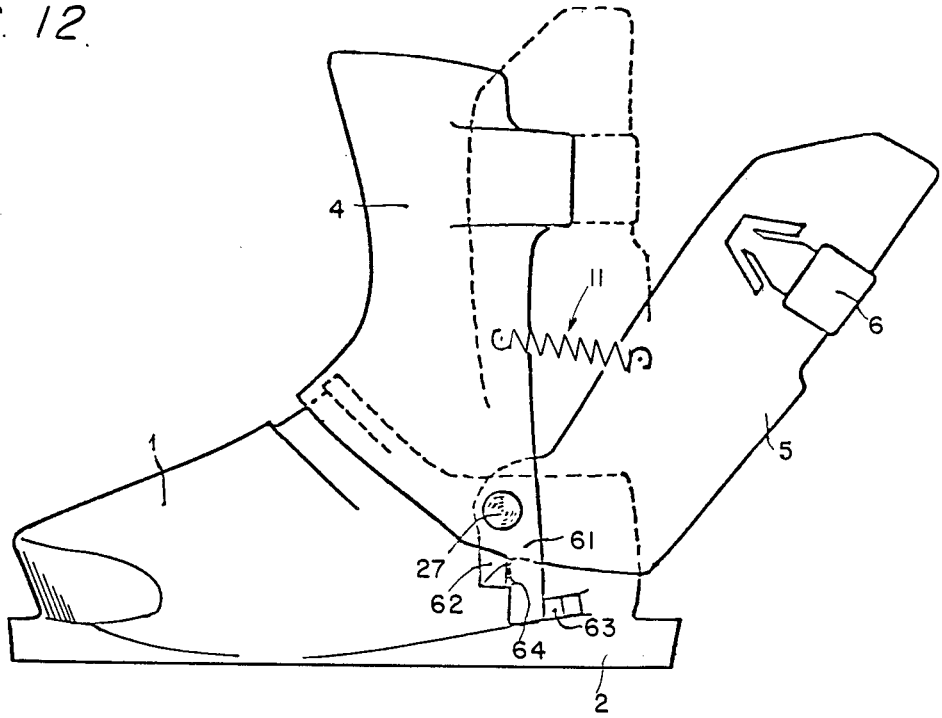
FIG. 13.
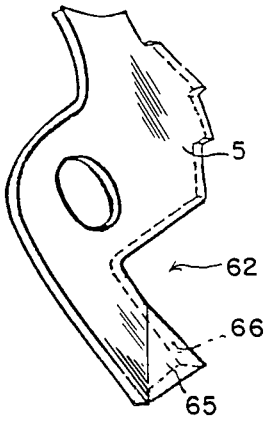
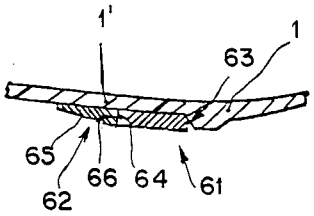
FIG. 12a

SKI BOOT

BACKGROUND OF THE INVENTION

1. Field of the Invention

The present invention relates to ski boots having a rigid shell base and which are adapted for rear-entry. More particularly, the invention relates to a ski boot which provides for the automatic closure of the boot on the leg of the skier.

2. Description of the Prior Art

Rear-entry type ski boots have a shell base and an upper. The upper comprises a cuff, and a rear spoiler adapted to pivot away from the cuff to permit entry of the foot and leg into the boot. Once the foot and leg are in the boot, the spoiler automatically closes on the cuff and around the leg of the skier. Automatic closure of the boot is understood to mean that manual manipulation by the skier to bend back the rear spoiler of the upper against the leg is not necessary once the skier has inserted his foot into the boot. To achieve this automatic closure, the majority of known boots provide an automatic closure system which is activated by the motor force of the weight of the skier exerted directly on the arch portion of the internal sole of the boot. In an alpine ski boot this sole is most often journalled at a point and acts as a lever whose one end is connected by various linkage means to at least one journalled portion of the shell of the boot. Such a boot is taught, for example, in Japanese Patent Application No. 57-86301.

In this type of boot, the closure of the rear spoiler immediately follows the introduction of the foot into the boot. In effect, as soon as the skier has introduced his foot into the boot, the force exerted by his weight on the internal sole causes the closure of the rear spoiler. As a result, the skier has no control over the closure of the boot, and cannot correctly position his foot in the rigid cavity of the shell base. This is also true when the boot comprises an internal foam sock designed to permit the skier to compensate only for small irregularities in the foot or in the positioning of the foot in the boot.

SUMMARY OF THE INVENTION

The present invention permits the skier to control the positioning of his foot in the shell base before the rear spoiler automatically closes. This is accomplished by utilizing the force exerted by the lower leg during the forward flexional movement to activate automatic closure of the rear spoiler, rather than using the weight of the skier as the activating force. Forward flexional movement is a voluntary action, not a passive one, on the part of the skier. This approach, therefore, permits the skier to achieve proper positioning of his foot in the shell base and it permits the skier to control the closure of the boot around his lower leg only after he has properly positioned his foot.

The present invention achieves these goals by providing a boot of the rear-entry type having a rigid shell base, and an upper at least partially journalled on the shell base, in which the voluntary forward flexional movement of the leg activates the spoiler.

At least a portion of the upper, e.g., the rear spoiler, is journalled on the shell base to allow for rear entry of the foot into the boot. Means are provided for latching the upper around the leg of the skier. The boot is constructed so that when forward flexional movement of the leg occurs, exerted on the front portion of the upper corresponding to the tibia support of the leg, the rear spoiler of the upper moves from the open position to a closed position around the leg of the skier. A means is also provided to relay this forward flexional movement to a retention means. As a result, the retention means is moved away from a blocking position, in which the retention means retained the rear spoiler in the open position against the bias of an elastic element. As soon as the rear spoiler is no longer blocked from moving forward by the retention means, the rear spoiler moves to its closed position around the leg of the skier due to the bias of the elastic element.

In one embodiment, the invention comprises a ski boot comprising a shell base and an upper at least partially journalled on the shell base. The upper comprises a cuff and a rear spoiler. The rear spoiler is adapted to move from an open position to a closed position. Also included is a means for automatically closing the spoiler from its open position in response to forward flexion of the cuff. In one embodiment the boot is of a rear-entry type ski boot.

The boot may also include a latching means for latching the cuff and rear spoiler together when the rear spoiler is in the closed position.

The automatic closing means comprises an elastic means for biasing the rear spoiler into its closed position. In one embodiment, the elastic means is positioned between the cuff and the rear spoiler. Alternatively, the elastic means can be positioned between the rear spoiler and the shell base. In another embodiment, the upper has two lateral walls, and the elastic means is positioned on both lateral walls such that the elastic means is attached at one end to the cuff and on its other end to the rear spoiler. In another embodiment, the rear spoiler is adapted to pivot around an axis, and the elastic means is positioned around or co-axial with the pivot axis of the rear spoiler. The elastic means may comprise spiral springs or helicoidal springs.

The automatic closing means further comprises a retention means for selectively retaining the rear spoiler in the open position against the bias of the elastic system. The retention means permits the rear spoiler to close under the bias of the elastic system in response to forward flexion of the cuff.

The automatic closing means also comprises relay means for relaying the forward flexion of the cuff to the retention means. In response to relaying this forward flexion to the retention means, the retention means permits the rear spoiler to close. In one embodiment, the retention means is adapted to move from a blocking position, in which the retention means blocks the rear spoiler from closing, to an open position, in which the rear spoiler is free to close.

In another embodiment the rear spoiler comprises the retention means, and the retention means is positioned between the rear spoiler and the shell base. Alternatively, the retention means can be positioned between the rear spoiler and the cuff.

In still another embodiment, the cuff is journalled on the shell base, and the rear spoiler is journalled on the cuff. Alternatively, the cuff and rear spoiler may be journalled on the shell base along either distinct axes or the same axis.

In an alternative embodiment, the cuff can have a tab extending downwardly from the journal axis of the cuff to the journal axis of the rear spoiler. In this embodiment, this tab comprises the relay means, the shell base comprises a heel having an abutment on the external periphery thereof, and the rear spoiler also comprises a rear heel portion. The retention means comprises a rib in the heel of the rear spoiler, which is adapted to engage the abutment of the shell base when the retention means is in its blocked position.

In the embodiment in which the cuff and rear spoiler are journalled on the shell base, the relay means may comprise a bent arm journalled on the rear portion of the rear spoiler. This arm is also attached to the bottom of the cuff. In this embodiment, the retention means comprises a lug positioned near or at the bottom of the arm, and the shell base comprises a complementary-shaped notch. The lug is adapted to engage the notch when the retention means is in the blocked position. In one embodiment, the arm has an upper portion above the point at which the arm is journalled on the rear spoiler. In this embodiment, the arm further comprises an elastic element positioned between the upper portion and the rear spoiler. The elastic element acts as a linkage means, linking the arm and the rear spoiler.

In still another embodiment, the cuff has a bottom rear portion, and the relay means comprises a surface on this bottom rear portion of the cuff. This surface is adapted to contact a support surface on the bottom portion of the rear spoiler. The rear spoiler further comprises a lower wall, and the retention means comprises a pin in the lower wall of the rear spoiler, which is adapted to selectively engage a notch in the external portion of the heel of the shell base. In this embodiment of the boot, the cuff and rear spoiler may be journalled on the shell base along distinct axes or along the same axis.

In the embodiment in which the cuff and rear spoiler are journalled on the shell base along the same axis, the cuff may have an internal wall, and the relay means comprises a first ramp positioned on this internal wall of the cuff, above the journal axis. In this embodiment, the shell base comprises a flexible blade having a second ramp thereon. The first ramp is adapted to engage the second ramp. In addition, the flexible blade further comprises an abutment, and the rear spoiler further comprises a shoulder. The abutment is adapted to selectively contact the shoulder and prevent forward movement of the rear spoiler. In this embodiment, the retention means comprises the abutment. In addition, in this embodiment, the elastic means may comprise a spring which is co-axial with the journal axis.

In an alternative embodiment, in which the cuff and rear spoiler are journalled on the shell base along the same axis, the cuff comprises a bottom portion below the journal axis having a ramp thereon. In this embodiment, the rear spoiler comprises a lower portion having a support tab extending downwardly therefrom. This support tab has a ramp on the front thereof. In addition, the shell base comprises an abutment adapted to selectively block the movement of the support tab. In this embodiment, the relay means comprises the ramp of the cuff, which is adapted to contact the ramp of the rear spoiler. In addition, the retention means in this embodiment comprises the abutment. Also, the ramp of the cuff comprises an upwardly directed point of a bevel. Preferably, the thickness of the bottom portion of the cuff is greater than the height of the abutment.

In the embodiment in which the cuff and rear spoiler are journalled on the shell base along distinct axes, the rear spoiler comprises a retractable retention flap having a ramp thereon. In addition, the cuff comprises an inner wall having a ramp and an abutment, both located at the edge of an opening therein. The ramp and the opening are positioned above the journal axis of the cuff. In this embodiment, the relay means comprises the ramp of the cuff, which is adapted to selectively engage the ramp of the rear spoiler. The ramp of the rear spoiler comprises a retention surface adapted to contact the abutment so that the retention means in this embodiment comprises the retention flap of the rear spoiler. The retention means is in its blocked position when the retention flap engages the opening.

In an alternative embodiment, in which the cuff and rear spoiler are journalled on the shell base on the same axis, the shell base comprises lateral walls, and the relay means comprises a ramp positioned on the lateral walls. The ramp is adapted to selectively contact a flap extending below the journal axis of the cuff. In this embodiment, the retention means comprises an abutment on the anterior side of the flap. This abutment is adapted to selectively block a retention flap positioned on the rear spoiler. The retention flap may comprise a ramp. This ramp is adapted to slide under the flap of the cuff when the rear spoiler is moved from the closed to the open position. The ramp on the retention flap can comprise means for assuring the passage of the retention flap from a closed position to an open position when the rear spoiler is moved from the closed position to the open position.

In still another embodiment, the latching means comprises an automatic ratchet-type latch, wherein the latching means is automatically locked in response to closing of the rear spoiler. The latching means may be positioned on each lateral side of the upper. In one embodiment, the latching means may comprise two parts disposed within one another, so that ratcheting of the parts occurs when the parts are moved within one another. Alternatively, the ratcheting of the parts may occur when one part is bent over the other.

In still another embodiment, a ski boot is provided for holding the foot and a portion of a leg of a skier. The boot comprises means for housing the foot and a portion of the leg. The boot also comprises a movable portion adapted to move from an open position, permitting entry of the foot into the boot, to a closed position. Also provided is a means for automatically closing the movable portion in response to voluntary movement of the skier after the foot is housed in the boot.

In this embodiment, the automatic closing means may comprise: elastic means for biasing the movable portion into the closed position; retention means for selectively retaining the movable portion in the open position against the bias of the elastic means so that the retention means also permits the rear portion to close under the bias of the elastic means in response to voluntary movement of the skier; and relay means for relaying the voluntary movement of the skier to the retention means so that the relay means causes the retention means to permit the rear portion to close under the influence of the elastic means in response to voluntary movement of the skier. The voluntary movement of the skier may comprise a voluntary movement of the leg, such as a forward flexion.

In still another embodiment, the invention comprises a method of closing an opened rear spoiler on a cuff of a ski boot. The method comprises the steps of flexing the cuff forward and automatically closing the spoiler on the cuff with an automatic closing means, in response to flexing of the cuff forward. In addition, the method may further comprise transmitting the forward flexion of the cuff to means for automatically closing the spoiler in response to flexing of the cuff.

In addition, the method may further comprise biasing the spoiler toward the cuff by an elastic means, blocking the spoiler from closing under the influence of this elastic means with a retention means, and unblocking the spoiler from closing by moving the retention means in response to forward flexion of the cuff.

In still another embodiment, the method includes blocking the spoiler by positioning the retention means between the spoiler and the cuff or by positioning the retention means between the spoiler and the shell base.

In another embodiment, the method further comprises journalling the spoiler around the cuff when the spoiler closes and journalling the cuff on the shell base when the cuff flexes forwards. Alternatively, the method may comprise journalling of the cuff and spoiler on the shell base around distinct axes or around the same axis when the cuff flexes forward and when the spoiler closes.

BRIEF DESCRIPTION OF THE DRAWINGS

The principle characteristics of the invention will now be described with particular reference to the attached drawings, given by way of non-limiting example only, in which:

FIGS. 3–10 illustrate various embodiments of a boot according to the invention which utilizes blocking the movement of the rear spoiler with respect to the shell base; more specifically;

FIG. 3 illustrates a schematic view of an alternative embodiment in which spoiler 5 is journalled directly on shell base 1;

FIG. 4 illustrates the journal arm 14 in FIG. 3;

FIG. 5 illustrates a schematic view of another embodiment in which spoiler 5 is journalled directly on shell base 1;

FIGS. 6 and 7 illustrate a schematic view of an alternative embodiment of the boot in which the axis around which cuff 4 and rear spoiler 5 are journalled are the same;

FIG. 8 illustrates a more detailed schematic view of a portion of the boot of FIG. 7;

FIGS. 9*a* and 9*b* illustrate the kinematics of the boot of FIG. 7;

FIG. 10 illustrates a schematic view of another embodiment of a boot of the present invention;

FIG. 10*a* illustrates a cross-sectional view taken through line a—a in FIG. 10;

FIG. 10*b* illustrates support flap 43 of the boot shown in FIG. 10;

FIGS. 11–13 illustrate schematic views of two embodiments of a boot according to the invention in which the rear spoiler is blocked from forward movement with respect to the cuff, and more specifically:

FIG. 11 illustrates a schematic view of a boot in which the spoiler and cuff are journalled on separate axes;

FIG. 11*a* illustrates a cross-sectional view taken through line a—a in FIG. 11;

FIG. 12 illustrates a schematic view of another embodiment of the present invention in which the axes around which the cuff and spoiler pivot are the same;

FIG. 12*a* illustrates a cross-sectional view taken through retention flap 62 and control flap 61; and FIG. 13 illustrates a partial perspective view of shell base 1, ramp 65, and retention flap 62.

DETAILED DESCRIPTION OF PREFERRED EMBODIMENTS

Figure 1:
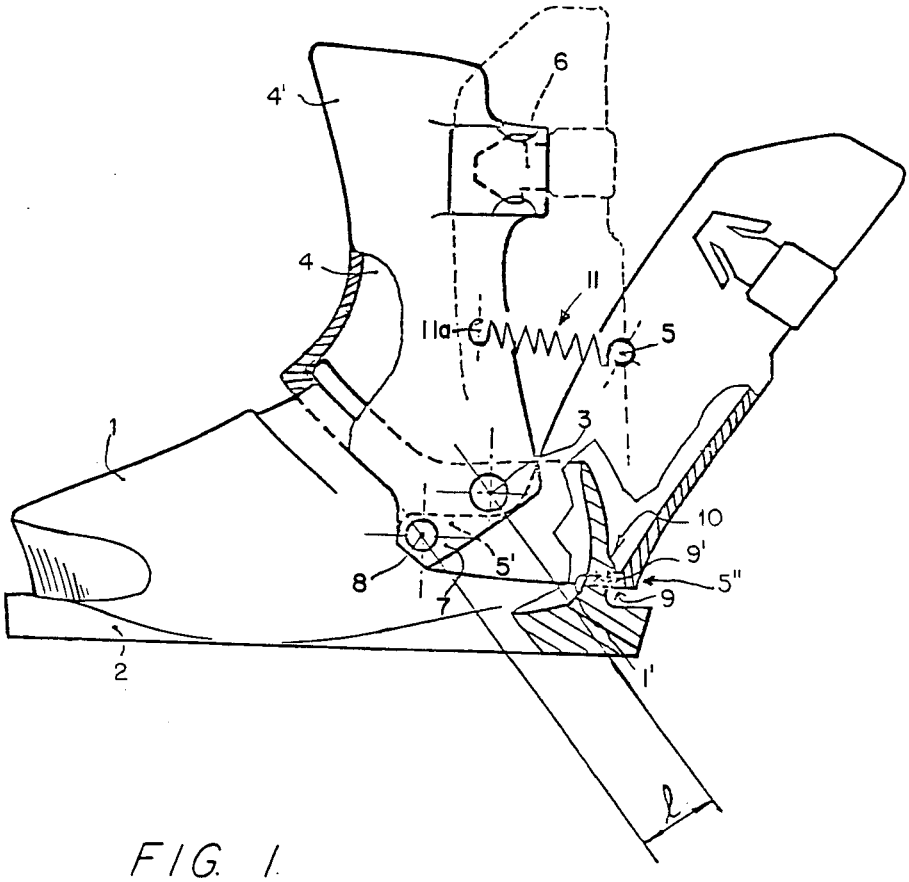
FIG. 1 illustrates a schematic view of a first embodiment of the invention.

FIG. 1 illustrates a first embodiment of the boot. This boot comprises a conventional rigid shell base 1 having a sole 2 on which an upper is journalled around a horizontal transverse axis 3. The upper comprises a front portion 4 and a rear portion 5 which will respectively be designated hereinafter as cuff 4 and rear spoiler 5, as is known in the field of alpine skiing. As is also known in the art, it is sufficient that only rear spoiler 5 be effectively journalled to allow for its pivoting rearwardly and that it be adapted to allow for easy introduction of the foot of the skier into the boot (i.e., rear entry). Furthermore, the upper is equipped at its upper portion 4', corresponding to the lower leg of the skier, with a latching apparatus 6 which maintains the closure of rear spoiler 5 with cuff 4 on the lower leg of the skier.

The automatic ratchet-type latching apparatus 6, as seen in FIG. 1, comprises two elements—one on spoiler 5 and the other on cuff 4. The element on spoiler 5 comprises elastically deformable arms that are adapted to be inserted into and engage an element on cuff 4. Latching apparatus 6 is shown in solid lines in the unlatched position in FIG. 1. In addition, spoiler 5 and the elastically deformable arms are shown in dotted lines in the latched position in FIG. 1.

The deformable arms are displaced toward each other when they begin their insertion into the element on cuff 4. Once the arms are completely inserted into the element on cuff 4, they return to their normal spaced apart position, thereby preventing rearward movement of these arms, as well as preventing the rearward movement of spoiler 5.

According to the embodiment shown in FIG. 1, cuff 4 is journalled on the shell base 1 around journal axis 3. Cuff 4 extends downwardly from axis 3 on each side of the upper. This downwardly extending portion of cuff 4 is in the form of a lateral tab or flap 7 on which is positioned a pivot axis pin 8. Pin 8 is spaced from journal axis 3 by a distance "l", such that lateral flap 7 serves as a control lever or lever arm 7 to relay the flexional force exerted by the leg of the skier on the upper portion 4' of the cuff corresponding to the tibial support of the leg, for example, to retention means that shall be discussed below. Furthermore, pivot axis 8 serves essentially as a linkage and journal axis of rear spoiler 5 on cuff 4 to which it is connected at its lower portion 5'. By means of axis pin 8, spoiler 5 is adapted to pivot from front to rear to assure the appropriate open position for insertion of the foot into the boot from the rear. The lower portion of rear spoiler 5 is provided with retention means 9 at its periphery 5'' corresponding to the zone of the heel. Retention means 9 comprises a retention rib 9' adapted to retain rear spoiler 5 in a stable, open position, when it contacts or abuts against an abutment 10 provided on the exterior periphery 1' of the heel of shell base 1. When abutment 10 is in the form of a notch, means 9 is adapted to engage notch 10 to prevent spoiler 5 from moving forward.

Finally, the upper portion of the upper is provided with latching or locking means adapted to maintain the rear spoiler in a closed position on the cuff. Preferably, this latching or locking means can comprise conventional hooks having buckles. Alternatively, the latching or locking means comprises an automatic ratchet-type latch whose advantages will be explained below.

As stated above, rear spoiler 5 is maintained in its stable, open position by retention means 9. Retention means 9 opposes the force on an elastic apparatus 11 which biases rear spoiler 5 toward cuff 4. Elastic apparatus 11 comprises, in the embodiment seen in FIG. 1, a traction spring positioned on both lateral sides of the upper and whose ends 11*a* and 11*b* are, respectively, integral with cuff 4 and rear spoiler 5. For aesthetic reasons, these traction springs are integrated with the lateral walls of the upper in a manner such that they are not visible. In addition, their configuration could be different than that schematically shown in FIG. 1 so as to allow for an even better integration with the exterior contours of the boot.

Figure 2:
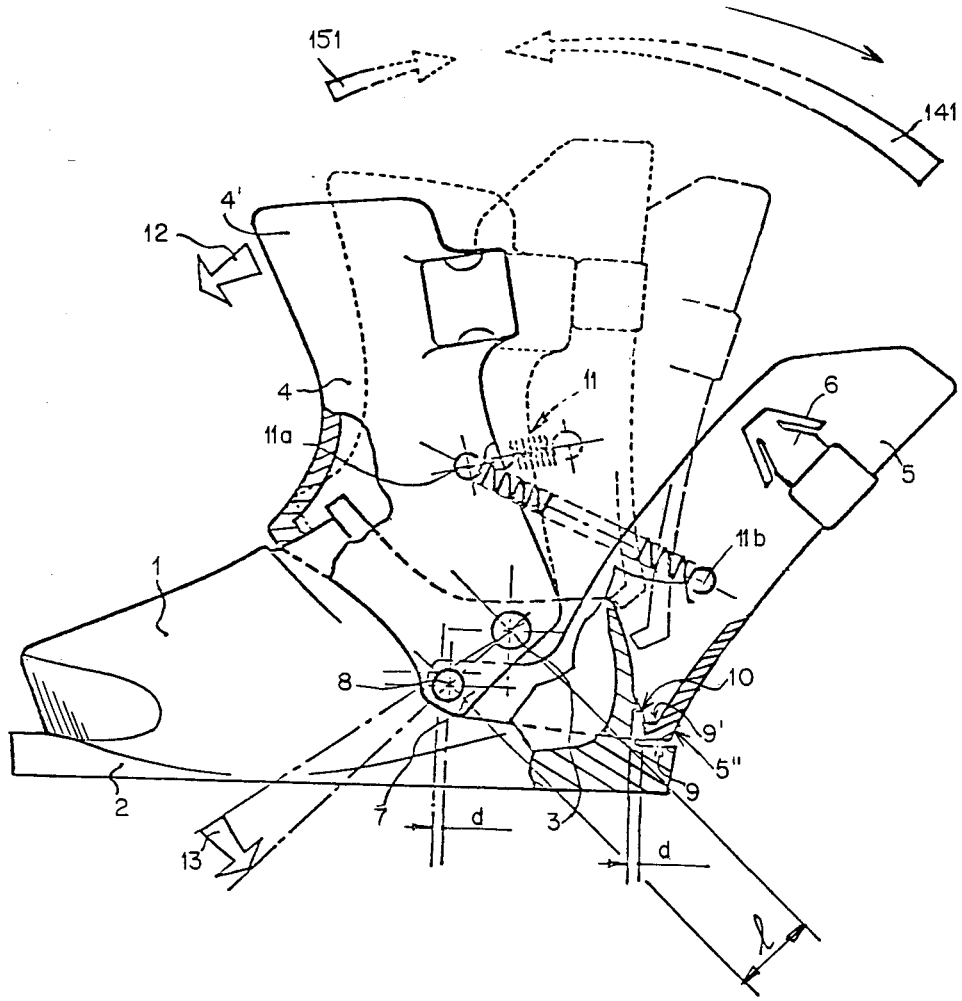
FIG. 2 illustrates the embodiment of FIG. 1 in different phases of closure of the boot.

FIG. 2 illustrates in greater detail the kinematic functioning sequence of the boot of the present invention. The sequence begins with the boot in the open, stable position. The skier then introduces his foot into the shell, and exerts a forward flexional movement with his leg. The force on this forward flexional movement is shown by arrow 12, and causes a pivoting of cuff 4 forwardly around transverse axis 3. As a result, control lever 7 is angularly displaced as indicated by arrow 13, around the same axis 3. This angular displacement of lever 7 causes a displacement, shown in FIG. 2 by the letter "d", of pivot axis 8 in the longitudinal direction, toward the rear of the boot. This rearward displacement of axis 8 simultaneously causes a rearward disengagement of lower edge 5'' of rear spoiler 5 from shell base 1. This is accomplished by the uncoupling or disengagement of retention rib 9' from abutment 10 positioned on the rear portion of shell base 1. As a result, there is no impediment to the forward movement of spoiler 5 and spring 11, attached at one of its ends on rear spoiler 5, forces spoiler 5 toward cuff 4. Rear spoiler 5 is, thus, pulled by spring 11 against cuff 4 while pivoting around its axis 8 as shown by arrow 141.

During this entire closure phase of the spoiler on the leg of the skier, the skier ceases applying flexional force on cuff 4 of the upper which returns, by virtue of its own elasticity, to its initial position (arrow 151). The skier need then only latch the upper in the closed position on his leg, by conventional means of hooks with buckles or closure straps. Alternatively, according to a preferred embodiment of the present invention, an automatic latching apparatus assures a maintenance of the closure of the boot on the foot without the necessity of performing any manipulation whatsoever. In one embodiment, this automatic latching apparatus is of the automatic ratchet-type which automatically locks in response to movement of the spoiler 5 from its open to its closed position. The latching apparatus is positioned on each lateral side of the upper and comprises two parts, which can be disposed one within the other. Ratcheting occurs when the parts are moved, one within the other. Alternatively, the two parts can be bent one over the other, and ratcheting occurs when one part is bent over the other.

The invention is not limited to boots in which the pivot axis of the rear spoiler is mounted on the cuff, which, in turn, is journalled on the shell base. It is within the scope of the invention to provide a rear spoiler 5 journalled around an axis 23 which is located directly on shell base 1. In this type of construction, which is illustrated in FIGS. 3, 4, and 5, rear spoiler 5 is also adapted to pivot open to permit insertion of the boot. In addition, the boot further comprises a relay means for relaying the flexional force from the leg and cuff to the retention means. The relay means can comprise either a journalled arm 14 provided with return spring 15 mounted on rear spoiler 5 (FIG. 3), or by a pushbutton 24 positioned on the bottom of the cuff 4 and acting on a support surface 25 of rear spoiler 5 (FIG. 5). In this latter case, the retention means is in the form of a latch 26 with an elastic return element. Latch 26 can be a pin in the lower wall of rear spoiler 5 is adapted to cooperate with a notch in the external portion of the heel of shell base 1. This retention means is positioned between shell base 1 and rear spoiler 5 and maintains rear spoiler 5 in the open position against the bias of a return spring 11, similar to that which has been described in the embodiment shown in FIGS. 1 and 2. When the foot is flexed forward, this forward flexional movement causes pushbutton 24 to move latch 26 so that it no longer prevents rear spoiler 5 from closing on cuff 4 under the bias of spring 11.

In the embodiment seen in FIG. 3, retention means 16 is provided between shell base 1 and rear spoiler 5 by means of journalled arm 14. FIG. 4 illustrates a perspective view of one embodiment of this journalled arm 14. This journalled arm in FIG. 4 comprises a stirrup journalled on rear spoiler 5 by means of an axis pin 17. The upper portion of arm 14 is provided with a disengagement latch 14' adapted to permit the insertion of return spring 15 therein during assembly. Spring 15 is fixed either on rear spoiler 5 or on arm 14 by means known to those skilled in the art. Spring 15 acts as a linkage means, linking arm 14 and rear spoiler 5. The lower portion of arm 14 comprises two side frame elements 18 and 18' whose ends 19 and 19' are supported on corresponding surfaces 20 and 20' of the rear lower edges of cuff 4. Furthermore, the central upper portion of arm 14 is provided at its lower end with a pin or apron or a reinforcement 21 adapted to engage corresponding opening 22 of the shell base 1. Rear spoiler 5 is prevented from closing or moving forward from its open position when reinforcement 21 is lodged in opening 22. When the foot undergoes a forward flexional movement, arm 14 relays this movement to reinforcement 21. Reinforcement 21 then disengages opening 22, thereby permitting rear spoiler 5 to close on cuff 4 under the action of a return spring 11 similar to that in FIGS. 1 and 2, but not shown in FIG. 3.

Figure 6:
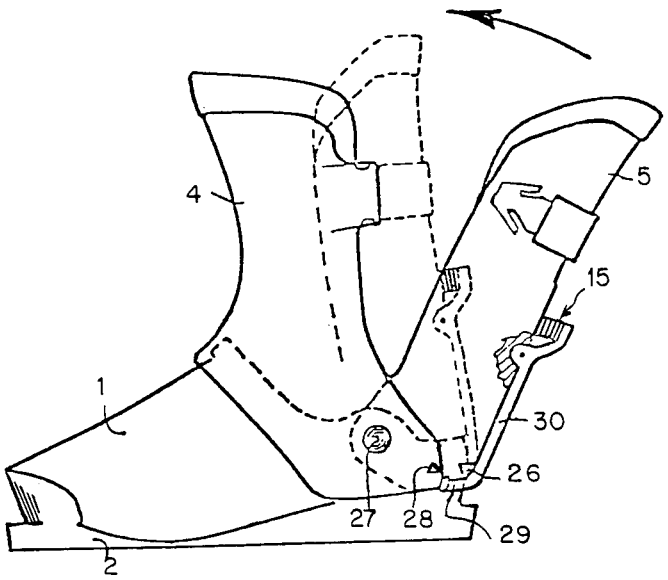

FIGS. 6–10 illustrate another embodiment of the boot of the present invention, in which cuff 4 and rear spoiler 5 are both adapted to pivot around journal axis 27. The embodiment illustrated in FIG. 6 follows the principle of construction of the embodiment shown in FIG. 3 to the extent that the bottom of cuff 4 is provided with a support surface 28 cooperating with swivel ball joint 29 of a relay means for relaying the flexional force from the leg to the retention means. In FIG. 6, the relay means comprise a journalled arm 30 provided with a return spring 15 and mounted with the latter on rear spoiler 5. However, unlike the boot shown in FIG. 3, the embodiment schematically shown in FIG. 6 comprises a single journal axis 27 around which the two elements of the upper, cuff 4 and rear spoiler 5, are adapted to pivot.

Figure 7:
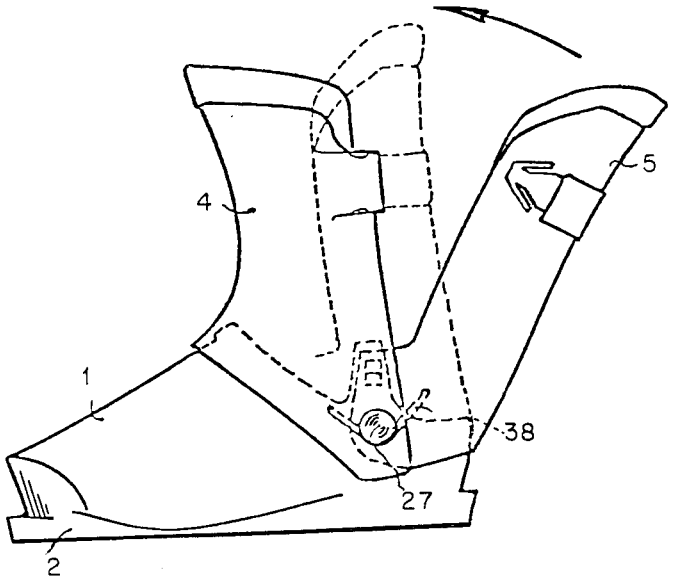

FIG. 7 illustrates another embodiment of the boot in which the pivot axes for rear spoiler 5 and cuff 4 are again coincident. In this embodiment, the mechanisms for relaying the flexional force from the leg to the retention means, as well as the retention means of rear spoiler 5 are positioned within the lateral walls of the boot. More precisely, these elements are approximately located at the level of the journal axis of the ankle. Retention means in this type of construction is such that it assures, for the embodiments which have been previously described, as well as for this embodiment, the blocking of the rear spoiler from movement toward the shell base.

FIG. 8 illustrates, in a detailed manner the functioning of the embodiment shown in FIG. 7, while FIGS. 9*a* and 9*b* succinctly illustrate the kinematics of such a boot mechanism.

In FIGS. 7–9*a*, rear spoiler 5 is shown in the open position, referred to as the entry position. Shell base 1 comprises, on each of its sides, a lateral elastic blade 31 oriented in a direction transverse to the longitudinal axis of the boot. Each elastic blade 31 is provided with an apparatus having two ramps 32 and 33 adapted to cooperate with slide surfaces 34 and 35. Slide surface 34 is part of rear spoiler 5 and slide surface 35 is part of cuff 4. Ramp 32, adapted to cooperate with slide surface 34, is oriented so as to form an acute angle directed frontward with respect to the longitudinal axis of the boot. Slide surface 34 of rear spoiler 5 is parallel to ramp 32. Ramp 32 ends in a surface perpendicular to the longitudinal axis of shell base 1 such that it constitutes an abutment stop 36 for a shoulder 37 of slide surface 34 of rear spoiler 5. Stop 36, therefore, functions as a retention means for preventing rear spoiler 5 from moving forward. Stop 36 retains spoiler 5 with respect to shell base 1. The rear spoiler is constantly biased forward against the abutment stops 36 by a spiral or arm spring 38 mounted on a common pivot or journal axis 27. Alternatively, helicoidal springs can be used in this embodiment or any of the preceding embodiments.

The upper portion of elastic blade 31 is provided with the second ramp 33 described above, but whose inclination with respect to the longitudinal axis of the boot is symmetrical. Ramp 33 cooperates with a corresponding slide surface 35 provided on cuff 4 forming relay means for relaying flexional force applied to the cuff as will be explained below.

The operation of this boot will now be described with reference to FIGS. 9*a*–9*b*.

During a forward flexion exerted by the skier on cuff 4 shown by arrow 39, slide surfaces 35 which are provided on the rigid lateral walls of cuff 4, are pressed against ramps 33, thereby causing the displacement of elastic blades 31 towards the interior of the boot. Ramps 32, which are below blades 31, are simultaneously pushed towards the interior of the shell base as indicated by arrows 40 in FIG. 9*b* and thus retract the surfaces of abutment stops 36 out of contact with shoulder 37 of the rear spoiler 5. Therefore, spoiler 5 has no impediment to its forward movement, and under the influence of return spring 38, rear spoiler 5 is then automatically moved forward (in the direction of arrow 41 in FIG. 9*b*) at the same time that stop 36 is disengaged from shoulder 37. When rear spoiler 5 is moved forward it is brought back into contact with the bottom of the leg of the skier who needs only to latch the assembly of the upper by known closure means. This latching by the skier is not necessary when the boot is provided with automatic ratchet-type latching means which latches or locks the boot automatically by using the force generated by the forward pivoting of the rear spoiler.

To open the rear spoiler for removal of the foot, the sequence of movements and displacements of the different parts with respect to one another described above is simply reversed. During this process, slide surface 34 of rear spoiler 5 displaces lower ramp 32 of blade 31 until shoulder 37 again abuts abutment 36 in a ratceht-type action to achieve the stable open position of rear spoiler 5. Elastic blades 31 can be either composed of materials different than those of the shell base, or be made of the same material as the shell base. In addition, in the embodiment shown in FIG. 8, a flexion groove 42 is provided which facilitates release of the blades toward the interior.

FIGS. 10–10*b* illustrate an embodiment in which blocking of the movement of rear spoiler 5 in the open position occurs with respect to shell base 1 by means of a lateral abutment 42 of shell base 1. Abutment 42 blocks movement of a support flap or tab 43 on rear spoiler 5. Tab 43 has a ramp 46 on the front thereof. In addition, tab 43 extends downwardly from the lower portion of the rear spoiler 5 and abuts abutment 42, thereby preventing rear spoiler 5 from moving forward from its open position. In this embodiment, rear spoiler 5 is journalled on shell base 1 around an axis 27 which coincides with the axis around which cuff 4 is journalled. Furthermore, a return spring 11*m* located in a similar manner to that of the embodiments which have been described above, biases in a permanent manner, rear spoiler 5 in the forward direction toward a closed position against the leg and cuff. By virtue of abutment 42, rear spoiler 5 is maintained in the open position against the bias of the elastic system.

When the skier exerts a forward flexion which is applied on cuff 4, cuff 4 pivots around axis 27. Extending downwardly from journal axis 27 on cuff 4 is a manipulation flap 44 provided with a ramp 45 in the form of a bevel having a rearwardly directed point. Therefore, as cuff 4 rotates (or, in other words, after cuff 4 makes a partial rotation), manipulation flap 44 and ramp 45 position themselves under support flap 43 of rear spoiler 5. In addition, as cuff 4 rotates, the point of beveled ramp 45 engages ramp 46 as shown in FIG. 10*a*. The continuation of the forward flexional movement causes support flap 43 to be spaced from shell base 1. In a preferred embodiment, manipulation flap 44 is thicker than the height of abutment 42, as seen in FIG. 10*a*. This causes narrow surface 43' of flap 43 to be spaced from abutment 42' so that surface 43' canot contact abutment 42. As a result, rear spoiler 5 is, instantaneously, no longer retained in its open position, or in other words, spoiler 5 is no longer blocked against forward movement against the shell base. Therefore, rear spoiler 5 pivots forward on cuff 4 under the influence of the permanent return bias of spring 11. Flaps 43 and 44 can be made of material which is applied to or molded directly with the upper. In the latter case, which is shown in FIGS. 10–10*b*, a small flexion groove 47 is provided on flap 43 so as to allow a certain lateral flexibility to permit the spacing of shell base 1 from support flap 43 as described above.

It is also within the scope of the invention to provide a boot in which the blocking of the movement of rear spoiler 5 in the open position is achieved by preventing movement of spoiler 5 relative to a movable cuff. In these embodiments, seen in FIGS. 11–13, the rear spoiler and cuff may be journalled on different axes or coincident axes.

FIGS. 11 and 11*a*, for the purposes of simplification, are limited to the details of the boot near the journal axis of the cuff and the pivot axis of the rear spoiler. In this embodiment, cuff 4 is journalled with respect to shell base 1 on a journal axis 48 and rear spoiler 5 is mounted to pivot on a second pivot axis 49 which is different from axis 48. A rear edge 50 of cuff 4 covers the anterior edge 51 of the journal ears 52 of rear spoiler 5. This overlapping zone of cuff 4 and rear spoiler 5 permits the relaying of the flexional forces from the cuff to retention means of the rear spoiler as will be explained below. As was previously discussed with respect to the preceding embodiments, return means for returning rear spoiler 5 to the closed position on the leg are provided by an elastic apparatus which is placed either between cuff 4 and the rear spoiler 5 (shown in FIGS. 2 and 5) or between shell base 1 and the rear spoiler 4 (as shown in FIG. 7).

FIG. 11 illustrates rear spoiler 4 in the open position, the return spring (not shown) being biased in this extended position. This stable, open position is achieved by the interposition of a retention flap 56, of journal ears 52 between cuff 4 and rear spoiler 5. Flap 56 comprises ramps 58 and flap 56 is preferably flexible in the transverse direction of the boot. Nevertheless, flap 56 assures the maintenance of rear spoiler 5 in the open position because it engages a corresponding opening 55 provided in the lower posterior edge 50 of the cuff. This opening is preferably positioned in the overlapping zone of spoiler 5 and cuff 4 and is also preferably positioned behind journal axis 48. As a result, opening 55 defines the summit of a triangle defined by axes 48 and 49 and opening 55, which consequently forms a system in stable equilibrium.

When the skier exerts a forward flexion on cuff 4, cuff 4 relays this force to retention flap 56 of spoiler 5 by means of a ramp 57 of opening 55 on cuff 4. Ramp 57 acts as a support surface and contacts a release counter-ramp 58 on retention flap 56, causing the the disengagement of flap 56 with opening 55. As a result, rear spoiler 5 is no longer retained and blocked against forward movement. Spoiler 5 then pivots forward by virtue of the permanent bias of the spring on the rear spoiler, and contacts the lower leg of the skier in the closed position. Conversely, when the skier wants to take off his boot, he moves rear spoiler 5 rearwardly until retention flap 56 again lodges itself in opening 55 of cuff 4, whose retention surface 59 comes into abutment with lower ramp 60 of the flap.

FIGS. 12–13 illustrate another embodiment in which the movement of the rear spoiler 5 is blocked with respect to movable cuff 4. In this embodiment of the boot, the journal axis of the cuff and the pivot axis of the rear spoiler area coincident along axis 27. Cuff 4 and rear spoiler 5 are provided at their lower portion, extending below pivot axis 27, respectively, with a control flap 61 and a retention flap 62. Rear spoiler 5 is prevented from rotating forward because retention flap 62 on spoiler 5 is blocked from moving forward by a support abutment 64 on the anterior narrow side of control flap 61 on cuff 4. Furthermore, a return spring 11 is positioned between the two portions of the upper in a manner which has already been described.

For this type of boot construction, the operation is somewhat different from that which has been described above, to the extent that the flexional forces on the cuff are not transmitted directly to the retention means of the rear spoiler, but are transmitted by means of a ramp 63 positioned on shell base 1. FIG. 12 shows such an embodiment with the foot inserted therein, i.e., with the rear spoiler pivoted rearwardly in its open position. So as to achieve the closure of the boot on the leg of the skier, the skier still exerts a forward flexion. The force of this flexion is relayed to control flap 61 which is integral with cuff 4. This force is then transformed into a force perpendicular to the plane of the lateral wall of the shell base where it is applied. Because cuff 4 pivots around axis 27, it follows that flap 61 contacts and travels along ramp 63 of shell base 1. As a result, a reaction force is created at ramp 63 which spaces flap 61 from the shell base 1. This transverse displacement of flap 61 moves abutment 64 out of contact with flap 62, thereby freeing retention flap 62 to move forward. Because rear spoiler 5 is constantly biased in the forward direction by return spring 11, flap 62 performs a rotation around axis 27 by pivoting between walls 1' of the shell base and flap 61 to occupy a closed position.

Conversely, to open the rear spoiler, the skier pivots rear spoiler 5 rearwardly. As a result, retention flap 62 which is provided with a spacing ramp 65, slides under control flap 61 and pushes it so as to allow flap 61 to move back to the position where it is pressed against shell base 1. This is accomplished by the engagement of stop surfaces 66 of retention flap 62 and support flap 64 of control flap 61.

So as to better understand the embodiments in FIG. 12, FIG. 13 illustrates in partial perspective view of the shell base, and the particular configuration of spacing ramp 65.

Although the invention has been described with reference to particular means, materials and embodiments, it is to be understood that the invention is not limited to the particulars disclosed and extends to all equivalents within the scope of the claims.

More particularly the constructions illustrated in FIG. 3, FIG. 4 and FIG. 6 show a return spring 15 which acts as a complementary part of the elastic means for biasing the spoiler into the closed position.

In these embodiments a portion of the of elastic means is positionned between rear spoiler 5 and shell base 1 by means of jounalled arm 14.

What is claimed is:

1. A ski boot comprising:

(a) a shell base;

(b) an upper, at least partially journalled on said shell base, comprising:

(i) a cuff; and (ii) a rear spoiler, wherein said rear spoiler is adapted to move from an open position to a closed position; and (c) means for automatically closing said spoiler in response to forward flexion of said cuff.

2. The ski boot defined by claim 1 wherein said boot is of the rear-entry type.

3. The ski boot defined by claim 1 further comprising latching means for latching said cuff and rear spoiler together when said rear spoiler is in said closed position.

4. The boot as defined by claim 3 wherein latching means comprises an automatic ratchet-type latch wherein said latching means is automatically locked in response to closing of said rear spoiler.

5. The boot as defined by claim 4 wherein said latching means is positioned on each lateral side of the upper portion of said upper.

6. The boot as defined by claim 4 wherein said latching means comprises two parts disposed within one another and the ratcheting of said parts occurs when said parts are moved within one another.

7. The boot as defined by claim 4 wherein said latching means comprises two parts and the ratcheting of said parts occurs when one part is bent over the other.

8. The ski boot defined by claim 1 wherein said automatic closing means comprises elastic means for biasing said rear spoiler into said closed position.

9. The ski boot defined by claim 8 wherein said elastic means is positioned between said cuff and rear spoiler.

10. The ski boot defined by claim 8 wherein said elastic means is positioned between said rear spoiler and said shell base.

11. The ski boot defined by claim 8 wherein said upper has two lateral walls and wherein said elastic means is positioned on both lateral walls wherein one end of said elastic means is attached to said cuff and the other end of said elastic means is attached to said rear spoiler.

12. The boot defined by claim 8 wherein said rear spoiler is adapted to pivot around an axis and wherein said elastic means is positioned around said pivot axis of said rear spoiler.

13. The boot defined by claim 8 wherein said elastic means comprises spiral springs.

14. The boot defined by claim 8 wherein said elastic means comprises helicoidal springs.

15. The boot defined by claim 8 wherein said automatic closing means further comprises retention means for selectively retaining said rear spoiler in said open position against the bias of said elastic system.

16. The boot defined by claim 15 wherein said retention means permits said rear spoiler to close under the bias of said elastic means in response to forward flexion of said cuff.

17. The boot defined by claim 16 wherein said automatic closing means further comprises relay means for relaying said forward flexion of said cuff to said retention means wherein, in response to said relaying, said retention means permits said rear spoiler to close.

18. The boot defined by claim 17 wherein said retention means is adapted to move from a blocking position, in which said retention means blocks said rear spoiler from closing, to an open position in which said rear spoiler is free to close.

19. The boot defined by claim 18 wherein said rear spoiler comprises said retention means and said retention means is positioned between said rear spoiler and said shell base.

20. The boot defined by claim 18 wherein said retention means is positioned between said rear spoiler and said cuff.

21. The boot defined by claim 18 wherein said cuff is journalled on said shell base around a journal axis and said rear spoiler is journalled on said cuff around a journal axis.

22. The boot defined by claim 21 wherein said cuff has a tab, extending downwardly from said journal axis of said cuff to said journal axis of said rear spoiler, wherein said tab comprises said relay means.

23. The boot defined by claim 22 wherein said shell base comprises a heel having an abutment on the external periphery of said heel and wherein said rear spoiler comprises a rear heel portion and said retention means comprises a rib in said heel of said rear spoiler which is adapted to engage said abutment when said retention means is in said blocked position.

24. The boot defined by claim 18 wherein said cuff and said rear spoiler are journalled on said shell base along distinct axes.

25. The boot as defined by claim 24 wherein said cuff comprises a bottom rear portion and said relay means comprises a surface on the bottom rear portion of said cuff adapted to contact a support surface on the bottom portion of said rear spoiler, and wherein said rear spoiler comprises a lower wall and said retention means comprises a pin in said lower wall of said rear spoiler and adapted to selectively engage a notch in the external portion of the heel of said shell base.

26. The boot defined by claim 24 wherein said rear spoiler comprises a retractable retention flap having a ramp thereon and wherein said cuff comprises an inner wall having a ramp and an abutment at the edge of an opening therein wherein said ramp is positioned above said journal axis of said cuff and wherein said relay means comprises said ramp of said cuff, wherein said ramp of said cuff is adapted to selectively engage said ramp of said rear spoiler, and wherein said ramp of said rear spoiler comprises a retention surface adapted to contact said abutment, wherein said retention means comprises said retention flap.

27. The boot as defined by claim 26 wherein said retention means is in said blocked position when said retention flap engages said opening.

28. The boot defined by claim 18 wherein said cuff and said rear spoiler are jounalled on said shell base along the same axis.

29. The boot as defined by claim 28 wherein said cuff has an internal wall and said relay means comprises a first ramp positioned on said internal wall of said cuff above said journal axis, wherein said shell base comprises a flexible blade comprising a second ramp, and wherein said first ramp is adapted to engage said second ramp, and wherein said flexible blade further comprises an abutment and said rear spoiler further comprises a shoulder, wherein said abutment is adapted to contact said shoulder and prevent forward movement of said rear spoiler, and wherein said retention means comprises said abutment.

30. The boot as defined by claim 29 wherein said elastic means is a spring coaxial with said journal axis.

31. The boot as defined by claim 28 wherein said cuff comprises a bottom portion below said journal axis having a ramp thereon and said rear spoiler comprises a lower portion having a support tab extending downwardly therefrom, and wherein said support tab has a ramp on the front thereof, and wherein said shell base comprises an abutment thereon, adapted to selectively block the movement of said support tab, and wherein said relay means comprises said ramp of said cuff, adapted to contact said ramp of said rear spoiler, and wherein retention means comprises said abutment.

32. The boot as defined by claim 31 wherein said ramp of said cuff comprises an upwardly directed point of a bevel and the thickness of said bottom portion of said cuff is greater than the height of said abutment.

33. The boot as defined by claim 28 wherein said shell base comprises lateral walls and said relay means comprises a ramp positioned on said lateral walls, wherein said ramp is adapted to selectively contact a flap extending below said journal axis on said cuff, and wherein said retention means comprises an abutment on the anterior side of said flap, wherein said abutment is adapted to selectively block a retention flap positioned on said rear spoiler.

34. The boot as defined by claim 33 wherein said retention flap comprises a ramp, wherein said ramp is adapted to slide under said flap of said cuff when said rear spoiler is moved from said closed to said open position.

35. The boot as defined by claim 34 wherein said ramp on said retention flap comprises means for assuring the passage of said retention flap from a closed position to an open position when said rear spoiler is moved from said closed to said open position.

36. The boot defined by claim 18 wherein said cuff and rear spoiler are journalled on said shell base, and wherein said relay means comprises a bent arm journalled on the rear of said rear spoiler and attached to the bottom of said cuff, and wherein said retention means comprises a lug positioned near the bottom of said arm, wherein said shell base comprises complementary-shaped notch, and wherein said lug is engaged in said notch when said retention means is in said blocked position.

37. The boot as defined by claim 36 wherein said arm has an upper portion above the point at which said arm is journalled on said rear spoiler and wherein said arm further comprises an elastic element positioned between said upper portion and said rear spoiler.

38. The boot as defined by claim 37 wherein said elastic element comprises linkage means linking said arm and rear spoiler.

39. The boot as defined by claim 38 wherein said cuff and rear spoiler are journalled in said shell base along distinct axes.

40. The boot as defined by claim 38 wherein said cuff and rear spoiler are journalled on said shell base along the same axis.

41. A ski boot for holding the foot and a portion of the leg of a skier, comprising:

(a) means for housing said foot and said portion of said leg;

(b) a movable portion adapted to move from an open position, permitting entry of said foot into said boot, to a closed position; and (c) means for automatically closing said movable portion in response to voluntary movement of said skier after said foot is properly positioned in said boot.

42. The boot defined by claim 41 wherein said automatic closing means comprises elastic means for biasing said movable portion into said closed position.

43. The boot defined by claim 42 wherein said automatic closing means further comprises retention means for selectively retaining said movable portion in said open position against the bias of said elastic means.

44. The boot defined by claim 43 wherein said retention means permits said rear portion to close under the bias of said elastic means in response to voluntary movement of said skier.

45. The boot defined by claim 44 wherein said boot further comprises relay means for relaying said voluntary movement of said skier to said retention means.

46. The boot defined by claim 44 wherein said relay means causes said retention means to permit said rear portion to close under the bias of said elastic means in response to voluntary movement of said skier.

47. The boot defined by claim 46 wherein said voluntary movement of said skier comprises voluntary movement of said leg.

48. The boot defined by claim 47 wherein said voluntary movement of said leg comprises forward flexion of said leg.

49. A method of closing an opened rear spoiler on a cuff of a ski boot comprising the steps of:

(a) flexing said cuff forward; and (b) automatically closing said spoiler with an automatic closing means, in response to flexing said cuff forward.

50. The method defined by claim 49 wherein said method further comprises:

(c) transmitting said forward flexing of said cuff to said means for automatically closing said spoiler in response to flexing of said cuff.

51. The method defined by claim 50 wherein said method further comprises:

(d) biasing said spoiler closed by an elastic means;

(e) blocking said spoiler from closing under the influence of said elastic means with a retention means;

(f) unblocking said spoiler from closing by moving said retention means in response to forward flexion of said cuff.

52. The method defined by claim 51 wherein said method further comprises:

(g) blocking said spoiler by positioning said retention means between said spoiler and said cuff.

53. The method defined by claim 51 wherein said boot comprises a shell base and said method further comprises:

(h) blocking said spoiler by positioning said retention means between said spoiler and shell base.

54. The method defined by claim 51 wherein said boot comprises a shell base and said method further comprises:

(i) journalling said spoiler around said cuff when said spoiler closes; and (j) journalling said cuff on said shell base when said cuff flexes forward.

55. The method defined by claim 51 wherein said boot comprises a shell base and said method further comprises the steps of:

journalling said cuff and spoiler on said shell base around distinct axes when said spoiler closes and when said cuff flexes forward.

56. The method defined by claim 51 wherein said boot comprises a shell base and said method further comprises the step of journalling of said cuff and spoiler on said shell base around the same axis when said cuff flexes forward and said shell base closes.

* * * * *